US005636992A

United States Patent [19]

Mastrangelo

[11] Patent Number: 5,636,992

[45] Date of Patent: Jun. 10, 1997

[54] LOW POWER PULSED LASER SIMULATOR

[75] Inventor: David Mastrangelo, Alpharetta, Ga.

[73] Assignee: Rockwell International Corporation, Seal Beach, Calif.

[21] Appl. No.: 576,276

[22] Filed: Dec. 21, 1995

[51] Int. Cl.[6] ..... F41G 1/00

[52] U.S. Cl. ..... 434/21; 434/11; 434/15; 434/16; 434/22

[58] Field of Search ..... 434/11, 12, 14–22, 434/27

[56] References Cited

U.S. PATENT DOCUMENTS

| | | | |
|---|---|---|---|
| 4,229,103 | 10/1980 | Hipp | 434/21 |
| 4,464,115 | 8/1984 | Simpson et al. | 434/27 |
| 4,959,016 | 9/1990 | Lawrence | 434/22 |

*Primary Examiner*—Jerome Donnelly
*Assistant Examiner*—Glenn E. Richman
*Attorney, Agent, or Firm*—Tom Streeter; Charles T. Silberberg

[57] ABSTRACT

The seeker of a guided missile may be tested by a simulator. The simulator mimics the reflection of a pulsed laser beam from a target. The simulator has a low power IR emitting LED 18. This IR emitting LED 18 is pulsed by an energy storing capacitor 22. The pulse is controlled by an SCR 16 driven by a pulse repetition oscillator 12. A collimating lens 26 collects light from the IR emitting LED 18 and directs it to the seeker. When being self tested, IR from the IR emitting LED 18 is reflected by a mirror 40 onto a detector 24. The output of the detector 24 is passed through a high pass filter 30. This removes signals from IR noise sources (fluorescent bulbs, the sun, incandescent bulbs), and passes only signals from the IR emitting LED 18. A first buffer 32, preferably an amplifier, provides power between the high pass filter 30 and the gate of a second SCR 34. This second SCR 34 drives a visible light LED 36 through a second buffer 38. The visible light LED 36 acts as a positive self test indication. Additional buffers, preferably of unity gain, are preferably provided to drive the pulse repetition oscillator 12 and the high pass filter 30.

10 Claims, 7 Drawing Sheets

| | | |
|---|---|---|
| Figure 2(a) | Figure 2(b) | Figure 2(c) |
| | Figure 2(d) | Figure 2(e) |

| | | |
|---|---|---|
| Figure 2(a) | Figure 2(b) | Figure 2(c) |
| | Figure 2(d) | Figure 2(e) |

Figure 2

NOTES: UNLESS OTHERWISE SPECIFIED

1. ALL CAPACITOR VALUES IN MICROFARADS
2. ALL RESISTOR TOLORANCES +/- 5%
3. USE PART NO. C30116 AS ALTERNATE FOR IR1
4. REFERANCE ASSEMBLY V705-50015

LOW POWER PULSED LASER SIMULATOR

BACKGROUND OF THE INVENTION

This invention relates to laser simulators and has special relation to pulsed light sources. Such sources simulate the reflection from a target which has been illuminated by a laser designator. The laser designator emits a pulsed beam, each pulse being approximately twenty nanoseconds long, and with a fixed pulse repetition frequency, typically ten hertz. A guided missile may be launched in the general direction of such a reflection. The missile's seeker will lock onto the reflection and will guide the missile to the target.

A pulsed laser reflection may be simulated by a laser or by any of a number of other light sources of the appropriate frequency. A pulsed light-emitting-diode (LED) is convenient, and is used both in the prior art and in the present invention.

Simulators are required because the seeker must be tested in the field just before use. The ideal time to perform this test is when the missile is aboard the helicopter which will launch it, just before the helicopter takes off. The simulator should produce enough light to be seen at least ten meters away, so that the simulator's operator may stand that far away and thereby avoid the helicopter's blade. It should be inexpensive and rugged, have long battery life, and give positive assurance that it is working.

This last requirement is important. If the seeker does not track the simulator, the missile must be removed and replaced with a missile whose seeker does track the simulator. If the fault is with the simulator and not with the seeker, this removal and replacement will be useless. The laser designator is designed, however, to use infrared radiation (IR), which is invisible to the human eye. This is done so that enemy soldiers will not know, from their own eyes, that they are targets. Discovering that they are targets (and, more importantly, where the laser designator is) requires sophisticated IR detection equipment, which they may not have. This same design, however, prevents the simulator's operator from simply looking into the simulator to see if it is working.

Prior art devices used high voltage batteries (typically one hundred volts) to produce high power pulses, and thereby attain adequate range. They accordingly drained their batteries quickly. High power meant high cost and high fragility. Further, the self test to see if the simulator was working was limited to assuring that the battery's voltage was still within specifications.

SUMMARY OF THE INVENTION

The present invention overcomes these problems by using a low voltage (nine volts may be used), low power, simulator. The simulator has a low power IR emitting LED. This IR emitting LED is pulsed by an energy storing capacitor. The pulse is controlled by a silicon controlled rectifier (SCR) driven by a pulse repetition oscillator. A collimating lens collects light from the IR emitting LED and directs it to the seeker, thereby eliminating the need for high voltage power sources.

When self tested, the IR from the IR emitting LED is reflected onto a detector. The output of the detector is passed through a high pass filter. This removes signals from IR noise sources (fluorescent bulbs, the sun, incandescent bulbs), and passes only signals from the IR emitting LED. The filter has a cut off frequency of several hundred hertz. Output from the detector generated by the IR emitting LED has significant energy above this frequency, mostly produced as the IR emitting LED is turned on and off. Output generated from fluorescent bulbs is essentially confined to sixty hertz. Output generated from the sun and incandescent bulbs is essentially DC.

A buffer, preferably an amplifier, provides power between the high pass filter and the gate of a second SCR. This second SCR drives a visible light LED, which acts as a positive self test. Additional buffers, preferably of unity gain, are preferably provided to drive the power source for the pulse repetition oscillator and the high pass filter. In each buffer, low voltage with practically no current is converted to low voltage with low, but significant, current. Power is thus added in modest (and inexpensive) increments, where and as it is needed.

BRIEF DESCRIPTION OF THE DRAWINGS

FIGS. 2(*a*) through 2(*e*) are a schematic drawing of a detailed embodiment of the present invention.

DETAILED DESCRIPTION OF THE DRAWINGS

Figure 1:
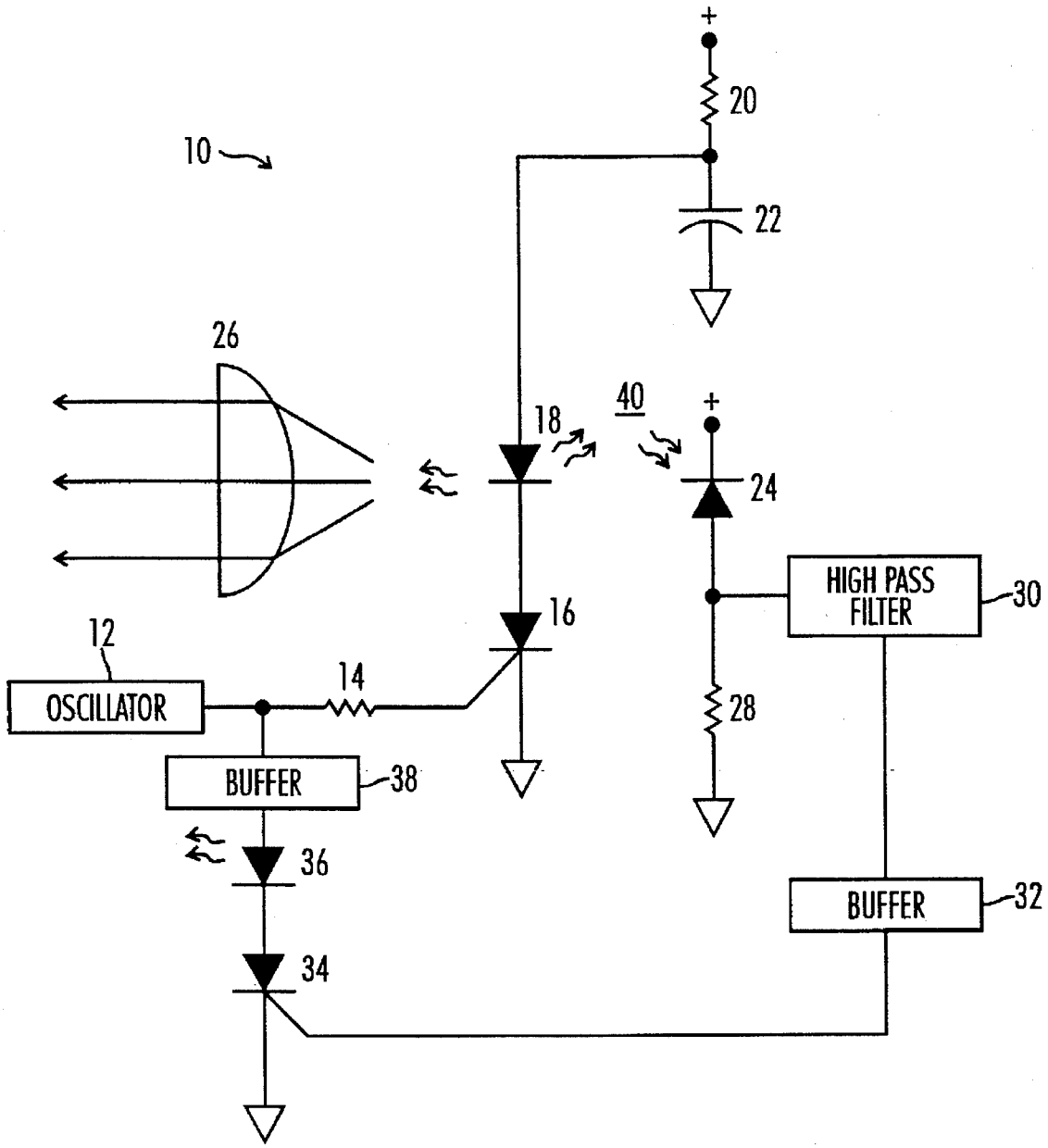
FIG. 1 is a schematic drawing of the overall structure of the present invention.
Figure 2A:
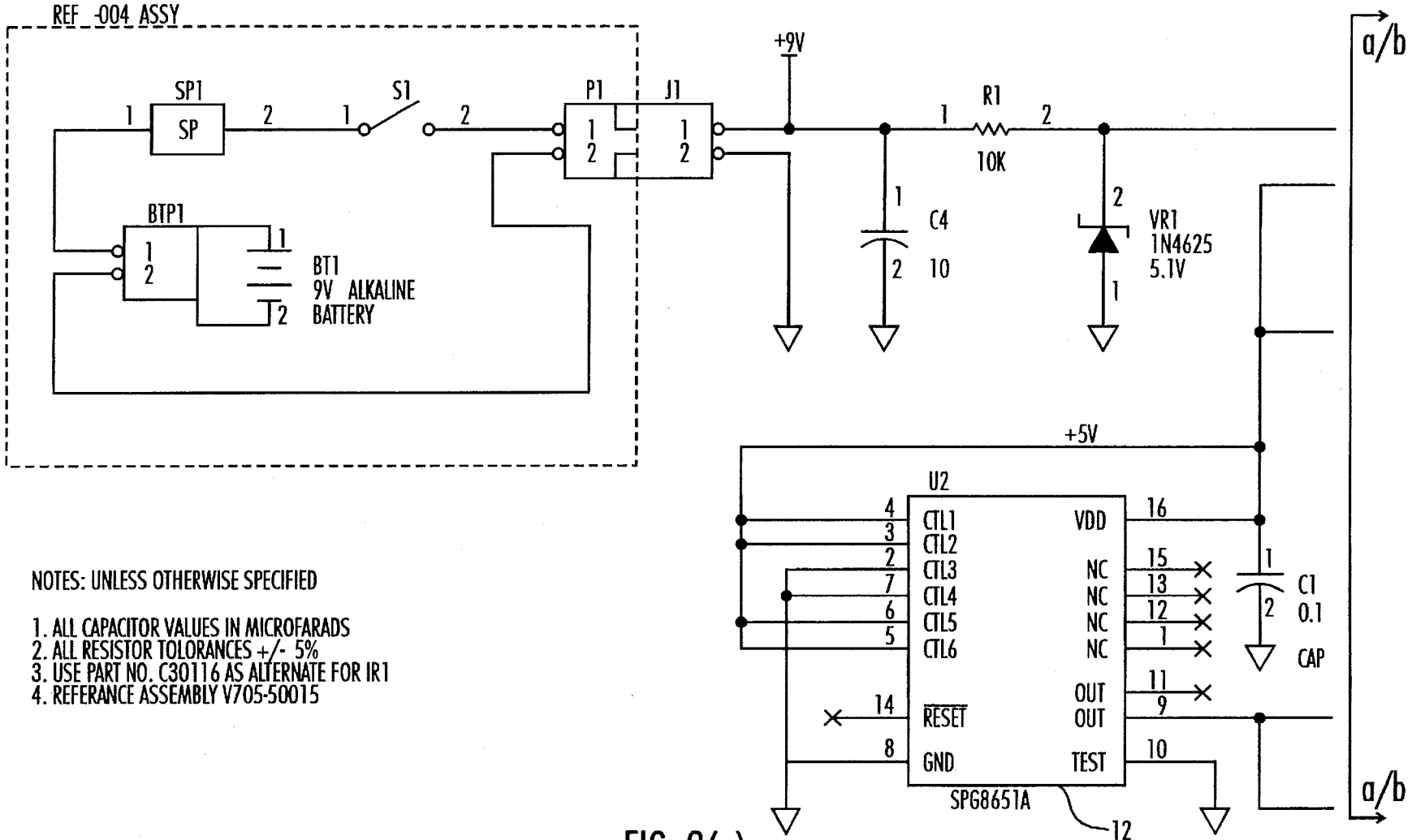
FIG. 2 shows the arrangement of FIGS. 2(*a*) through 2(*e*).
Figure 2B:
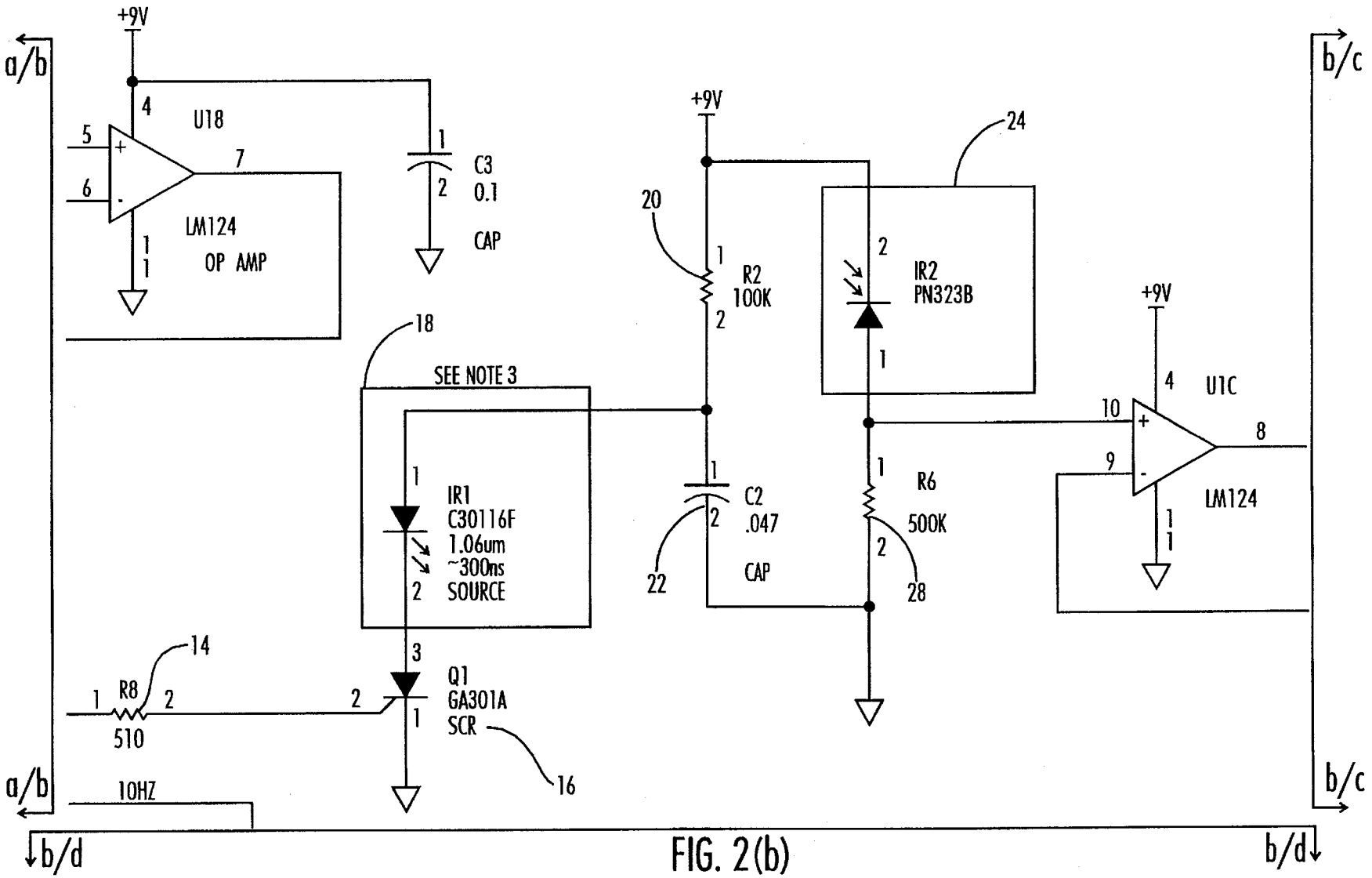
Figure 2C:
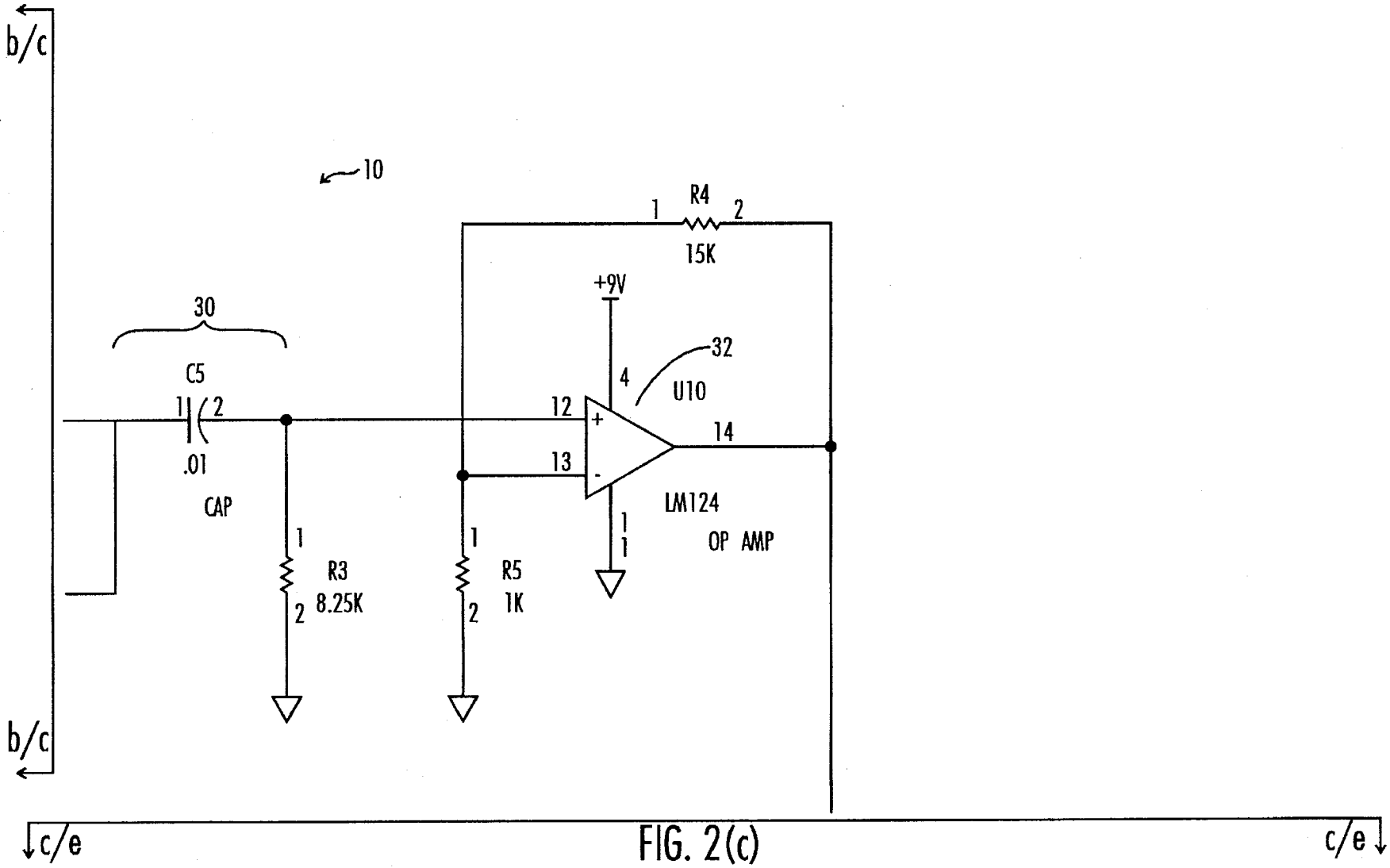
Figure 2D:
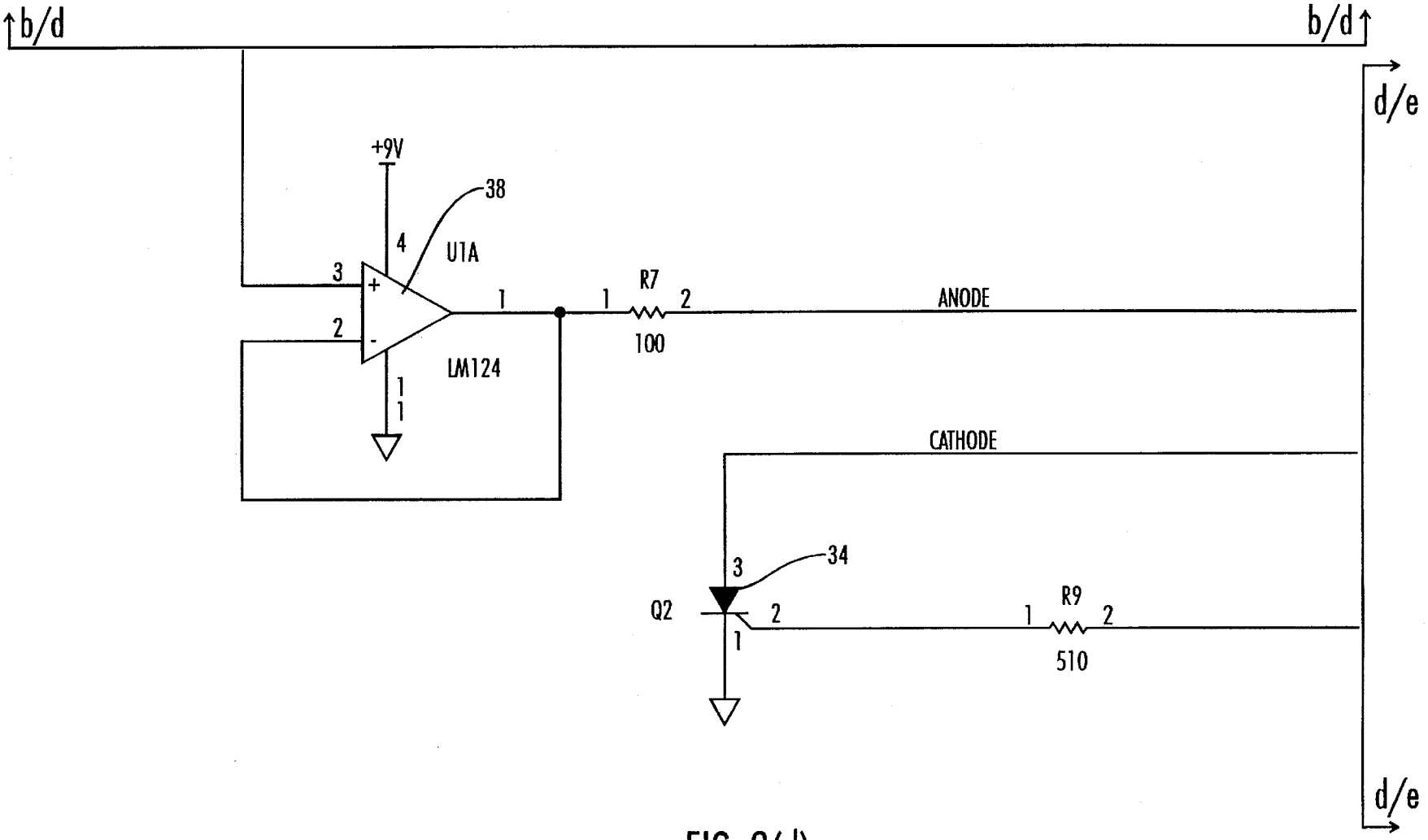
Figure 2E:
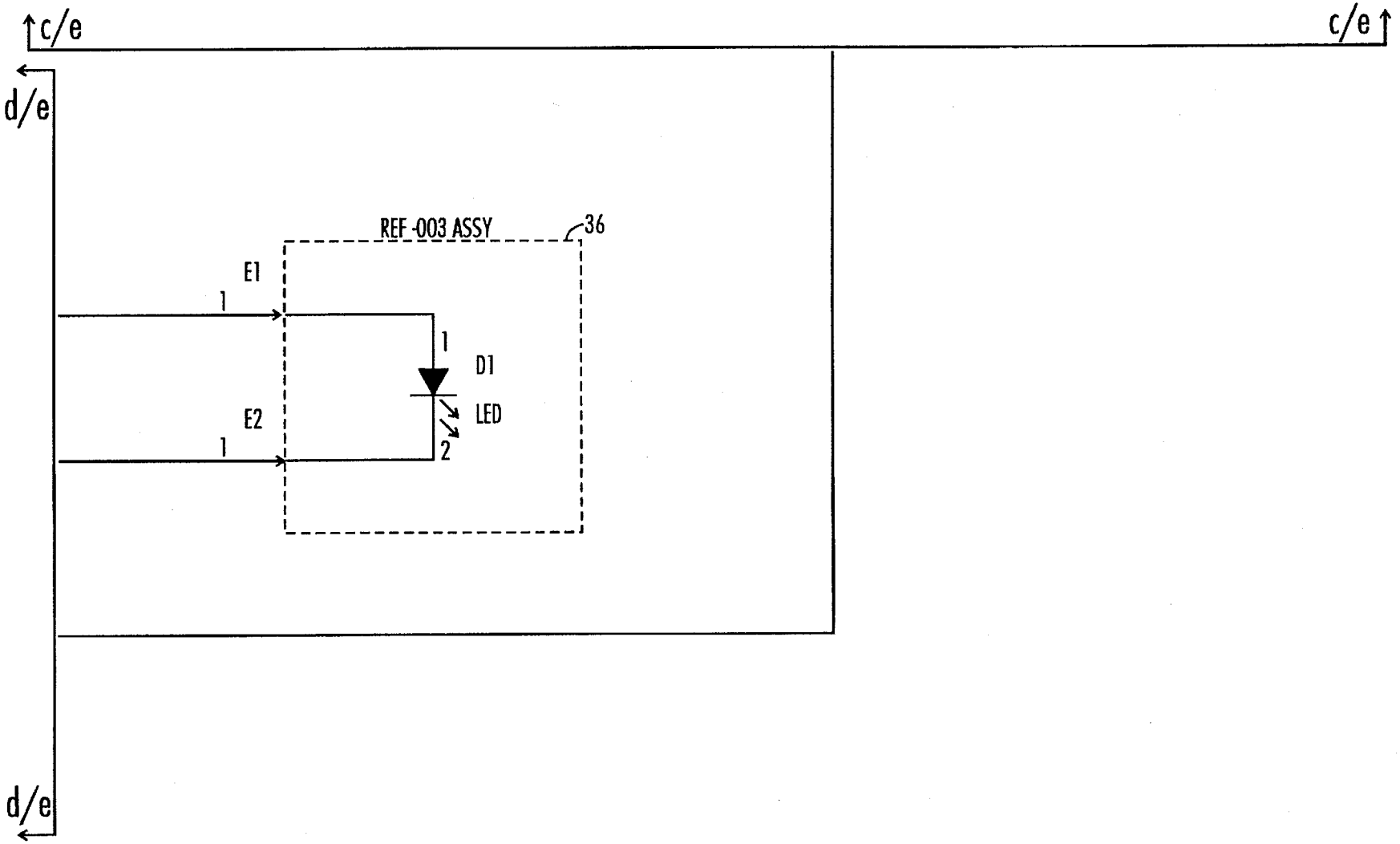

FIG. 1 is a schematic drawing of the overall structure 10 of the present invention.

An oscillator 12 is configured to produce an output through a first resistor 14 at a desired pulse repetition frequency. A first silicon controlled rectifier (SCR) 16 has a gate which is controlled by the output of the oscillator 12. The cathode of the first SCR 16 is grounded. An infra-red radiation (IR) light-emitting-diode (LED) 18 has a cathode which is connected to the anode of the first SCR 16. A second resistor 20 has a higher voltage side which is connected to a voltage source, and has a lower voltage side which is connected to the anode of the IR emitting LED 18. A capacitor 22 has a higher voltage side which is connected to the anode of the IR emitting LED 18, and a lower voltage side which is grounded.

An IR detector 24 has a cathode which is connected to the voltage source, and is positioned to detect reflected light emitted from the IR emitting LED 18. The unreflected light, however, is directed through a collimating lens 26, which preferably is plano-convex. A third resistor 28 has a higher voltage side which is connected to the anode of the IR detector 24, and has a lower voltage side which is grounded.

A high pass filter 30 has an input connected to the anode of the IR detector 24, and has a cutoff frequency greater than sixty hertz. A first buffer 32 has an input connected to the output of the high pass filter 30. A second SCR 34 has a gate which is controlled by the output of the first buffer 32, and has a cathode which is grounded. A visible light LED 36 has a cathode which is connected to the anode of the second SCR 34, and has anode which is connected, through a third buffer 38, to the output of the oscillator 12.

Operation is apparent from the foregoing structure. The voltage source charges the capacitor 22 through the second resistor 20. When the oscillator 12 pulses the gate of the first SCR 16, the first SCR 16 becomes conductive and discharges the capacitor 22 through the IR emitting LED 18. The IR emitting LED 18 emits a pulse of infra-red light, which is collimated by lens 26 to actuate a missile seeker (not shown). The length of this pulse is preferably approximately twenty nanoseconds, but can be longer depending on the application. It is determined by the RC time constant calculated by taking the (very small) resistance through the IR emitting LED 18 and first SCR 16, and multiplying it by the capacitance of the capacitor 22.

It is a property of SCRs that they become non-conductive as soon as the anode voltage is removed from them. First SCR 16 therefore becomes non-conductive as soon as the capacitor 22 has finished discharging, since the second resistor 20 prevents the voltage source from keeping the first SCR 16 in a conductive state.

When self tested, the reflected pulse of light from the IR emitting LED 18 falls on the IR detector 24 and renders it conductive. FIG. 1 shows a light path both to the lens 26 and, in the test mode, using a mirror 40 (preferably a highly polished piece of stainless steel) to reflect the light. The mirror 40 is preferred, but may be omitted if the application demands unreflected light.

Noise in the output of the IR detector 24 is removed by the high pass filter 30. The high pass filter 30 has a cutoff frequency above sixty hertz, and therefore filters out sixty cycle hum. This could easily be caused by fluorescent light falling on the IR detector 24. It also filters out direct current (dc), which could easily be caused by incandescent light or sunlight falling on the IR detector 24. Only the ten hertz pulse initiated by the oscillator 12 is passed by the high pass filter 30 to the first buffer 32. Despite the fact that the ten hertz pulse appears to be below the sixty hertz cutoff, output from the IR detector 24 which was generated by the IR emitting LED 18 in fact has significant energy above this frequency, mostly produced as the IR emitting LED 18 is very quickly mined on and off.

When the IR detector 24 becomes conductive, a small current is passed through the third resistor 28. The high side of the third resistor 28 provides a signal input which requires buffering, because the IR detector 24 and high pass filter 30 cannot pass very much current. The first buffer 32 provides such current. It may be any device which provides substantial current in response the change in voltage. An operational amplifier, with or without resistors to change its gain from unity, is suitable.

When this buffer output signal arrives at the gate of second SCR 34, it causes the second SCR 34 to become conductive. The pulse from oscillator 12 therefore travels through the third buffer 38, the visible light LED 36, and the second SCR 34 to ground, rather than through first resistor 14. The second SCR 34 continues to conduct until the output voltage of the oscillator 12 goes low. At the preferred pulse repetition frequency often hertz, this is fifty milliseconds. The first SCR 16, it will be recalled, conducted for only approximately twenty nanoseconds. The visible light LED 36 may be relatively low power, since it will be viewed from well under a meter. It is important, however, that each pulse be sufficiently long as to be detectable by the naked eye. The foregoing structure, which provides a ten hertz pulse repetition frequency and a fifty percent duty cycle, satisfies this requirement.

FIG. 2, as best seen by laying out FIGS. 2(*a*) through 2(*e*) in the manner shown in FIG. 2, is a schematic drawing of a detailed embodiment of the present invention.

Beginning at the upper left comer of FIG. 2, a nine volt battery BT1 provides power through a low pass filter consisting of capacitor C4, and is regulated to five volts by regulator VR1 and resistor R1. A unity gain buffer U1B (the "fourth buffer") consists of an operational amplifier, the negative input of which is tied to its output, without resistors, and provides five volts as needed. Capacitor C3 disposes of high frequency noise from the nine volt source powering the fourth buffer. Fourth buffer U1B is one of four identical operational amplifiers provided on part number LM124 manufactured by National Semiconductor Corp., of Santa Clara, Calif. 95052. Its use is not strictly necessary, but is easily provided since LM124 is low power and so inexpensive. Buffer U1B is the least important of the four buffers, and is therefore called the fourth buffer.

A high precision (plus or minus five parts per million) programmable oscillator, preferably the SPG8651A manufactured by Epson America Corp., of Torrance, Calif. 90503, is powered by this buffered voltage, and has the appropriate control lines held at the appropriate voltages to produce the desired ten hertz output frequency. Additional high frequency noise in the power voltage is disposed of by capacitor C1. SPG8651A is the oscillator 12 of FIG. 1, and is accordingly so marked.

The output of the SPG8651A passes through resistor R8 (first resistor 14 of FIG. 1) to the gate of SCR Q1 (the first SCR 16 of FIG. 1). This drives IR emitting LED IR1 (LED 18 of FIG. 1), the anode of which is connected to the node formed by resistor R2 and capacitor C2 (second resistor 20 and capacitor 22, respectively, of FIG. 1). Light from IR1 is reflected onto IR2 (IR detector 24 of FIG. 1), which passes a current from the voltage source through resistor R6 (third resistor 28 of FIG. 1) to ground. Buffer U1C (the "third buffer") is structured the same as fourth buffer U1B, and receives its input from the IR2/R6 node. Its output is passed through capacitor C5 and resistor R3, which together form the high pass filter 30 of FIG. 1. The output of this filter is applied to buffer U1D (first buffer 32 of FIG. 1), which is additionally structured by resistors R4 and R5 to be a fifteen-to-one voltage amplifier. Buffer U1C is the next least important of the four buffers, and is therefore called the third buffer.

This buffered, amplified signal is applied to the gate of SCR Q2 (the second SCR 34 of FIG. 1), which turns on visible light LED D1 (LED 36 of FIG. 1). LED D1 is driven by buffer U1A (second buffer 38 of FIG. 1) through resistor R7. Second buffer U1A is also structured the same as buffer U1B. Second buffer U1A is also driven by the output of the SPG8651A.

SCOPE OF THE INVENTION

While an embodiment of the present invention has been described in considerable detail, the true scope and spirit of the invention are not limited thereto, but are limited only by the appended claims and their equivalents.

What is claimed is:

1. A pulsed laser simulator comprising:

(a) an oscillator configured to produce an output at a desired pulse repetition frequency;

(b) a first resistor, a higher voltage side of which is connected to the oscillator;

(c) a first silicon controlled rectifier (SCR), a gate of which is controlled by a lower voltage side of the first resistor, and a cathode of which is grounded;

(d) an infra-red radiation (IR) light-emitting-diode (LED), a cathode of which is connected to an anode of the first SCR;

(e) a second resistor, a higher voltage side of which is connected to a voltage source, and a lower voltage side of which is connected to an anode of the IR emitting LED;

(f) a capacitor, a higher voltage side of which is connected to the anode of the IR emitting LED, and a lower voltage side of which is grounded;

(g) an IR detector, a cathode of which is connected to the voltage source, positioned to detect light emitted from the IR emitting LED;

(h) a third resistor, a higher voltage side of which is connected to an anode of the IR detector, and a lower voltage side of which is grounded;

(i) a high pass filter, having an input connected to the anode of the IR detector, and having a cutoff frequency greater than sixty hertz;

(j) a buffer having an input connected to an output of the high pass filter;

(k) a second SCR, a gate of which is controlled by an output of the first buffer, and a cathode of which is grounded;

(l) a visible light LED, a cathode of which is connected to an anode of the second SCR; and (m) a second buffer having an input connected to the output of the oscillator, and having an output connected to an anode of the visible light LED.

2. The pulsed laser simulator of claim 1, further comprising a current-limiting resistor between the output of the first buffer and the gate of the second SCR.

3. The pulsed laser simulator of claim 1, further comprising a mirror situated to reflect IR from the IR emitting LED to the IR detector.

4. The pulsed laser simulator of claim 1, wherein the first buffer has gain in excess of unity.

5. The pulsed laser simulator of claim 4, further comprising a current-limiting resistor between the output of the first buffer and the gate of the second SCR.

6. The pulsed laser simulator of claim 1, further comprising a third buffer having an input connected to the anode of the IR detector, and having an output connected to the input of the high pass filter.

7. The pulsed laser simulator of claim 1, further comprising a fourth buffer having an input connected to a voltage source, and having an output connected to the oscillator.

8. The pulsed laser simulator of claim 1, further comprising a current-limiting resistor between the output of the second buffer and the input of the visible light LED.

9. The pulsed laser simulator of claim 1, further comprising:

(a) a current-limiting resistor between the output of the first buffer and the gate of the second SCR;

(b) a current-limiting resistor between the output of the second buffer and the input of the visible light LED;

(c) a third buffer having an input connected to the anode of the IR detector, and having an output connected to the input of the high pass filter; and (d) a fourth buffer having an input connected to a voltage source, and having an output connected to the oscillator.

10. The pulsed laser simulator of claim 4, further comprising:

(a) a current-limiting resistor between the output of the first buffer and the gate of the second SCR;

(b) a current-limiting resistor between the output of the second buffer and the input of the visible light LED;

(c) a third buffer having an input connected to the anode of the IR detector, and having an output connected to the input of the high pass filter; and (d) a fourth buffer having an input connected to a voltage source, and having an output connected to the oscillator.

* * * * *